US005192130A

United States Patent [19]

Endo et al.

[11] Patent Number: 5,192,130

[45] Date of Patent: Mar. 9, 1993

[54] METHOD FOR PRODUCING AN EMULSION AND AN APPARATUS THEREFOR

[75] Inventors: Kiyoshi Endo; Masami Ishikura, both of Hachioji, Japan

[73] Assignee: Konica Corporation, Tokyo, Japan

[21] Appl. No.: 664,787

[22] Filed: Mar. 5, 1991

[30] Foreign Application Priority Data

Mar. 6, 1990 [JP] Japan ..... 2-54249

[51] Int. Cl.[5] ..... B01F 15/04

[52] U.S. Cl. ..... 366/161

[58] Field of Search ..... 366/336, 337, 338, 339, 366/340, 166, 152, 162, 160, 161, 156

[56] References Cited

U.S. PATENT DOCUMENTS

| | | | |
|---|---|---|---|
| 3,266,780 | 8/1966 | Waters | 366/152 |
| 3,827,888 | 8/1974 | Terwilliger | 366/156 |
| 3,924,989 | 12/1075 | Alhausen | 366/336 |
| 4,433,701 | 2/1984 | Cox | 366/152 |

*Primary Examiner*—Robert W. Jenkins

*Attorney, Agent, or Firm*—Finnegan, Henderson, Farabow, Garrett and Dunner

[57] ABSTRACT

A process of making emulsion for photographic material being prevented from coarse oil globules mixed-in which causes visible spots on the final products is disclosed. Before mixing and emulsifying oil phase and water phase in an emulsifying tank, said two phases are pre-mixed air-tightly in an in-line-mixer to minimize the above mentioned trouble.

11 Claims, 1 Drawing Sheet

METHOD FOR PRODUCING AN EMULSION AND AN APPARATUS THEREFOR

FIELD OF THE INVENTION

The present invention relates to a method for producing an emulsion and an apparatus therefor, and more particularly to a method of producing an oil-in-water type emulsion in which the oil globules are prevented from growing coarse and an apparatus used therefor.

BACKGROUND OF THE INVENTION

The oil-in-water type emulsion technology is widely used in producing photographic light-sensitive materials, cosmetics, foods, paints and chemicals.

For example, in the field of photographic light-sensitive materials, color image-forming compounds such as color couplers, diffusion transfer compounds, antistain agents, anti-discoloration agents, anti-color-mixing agents, ultraviolet absorbing agents, color-increasing agents and the like are used as oil-soluble substances for making their emulsions. The preparation of oil-in-water type emulsions of such oil-soluble substances has conventionally been made in the manner that an oil phase solution prepared by dissolving the oil-soluble substance in an organic solvent or emulsification aid or in an organic solvent solution of an emulsification aid or, where the oil-soluble substance is solid, by heating or dissolving it in an organic solvent (hereinafter merely called an oil phase solution) is added to be emulsified/-dispersed in a water-soluble binder-containing and as needed an emulsification aid-added water phase solution (hereinafter merely called a water phase solution) to thereby produce an oil-in-water type emulsion having an average oil globular size of about 0.1 to 1.0 μm.

As the above organic solvent, in many cases, a low-boiling solvent having a lower boiling point than that of water, such as ethyl acetate, is used.

A conventional procedure for the above emulsion preparation is such that the water phase solution is put in a stirrer-provided emulsification tank, and onto the surface of the solution, with stirring, is added the oil phase solution.

In addition, there are other procedures: addition by conduction of the oil phase into the water phase solution as disclosed in Japanese Patent Publication Open to Public Inspection (hereinafter abbrebiated to JP O.P.I.) No. 203632/1984; and conduction of the water phase into the oil phase solution to the contrary. These procedures, however, have difficulty in securely adding all the amount of one phase solution to the other because, when forcibly conducting the adding phase by, e.g., a pump, there is a possibility of undesirable air-mixing at the end of the conduction, in which the air-mixing occurrence causes a large amount of foam, giving additional troubles to work.

Therefore, the foregoing addition of the oil phase onto the surface of the water phase solution is generally used. In this instance, however, the oil phase solution is splashed up onto the inside wall of the emulsification tank, the oil phase substance, after the emulsification, is dripped from the wall to be mixed in the dispersion, resulting in coarse oil globules of the undispersed oil phase substance which, when the dispersion is used in, e.g., a light-sensitive material, may sometimes cause coating trouble such as pinholes.

SUMMARY OF THE INVENTION

It is an object of the present invention to provide a means of preventing coarse oil globules from occurring in a method for producing an emulsion and an apparatus used therefor.

It is another object of the invention to provide a method for preventing coating trouble attributable to the formation of coarse oil globules and an apparatus used therefor.

The above objects are accomplished by a method for producing an emulsion by a stirrer/disperser, in which said method comprises a predispersion procedure for dispersing a water phase solution and an oil phase dispersion beforehand, and by an apparatus used for said method.

DETAILED DESCRIPTION OF THE INVENTION

Figure 1:
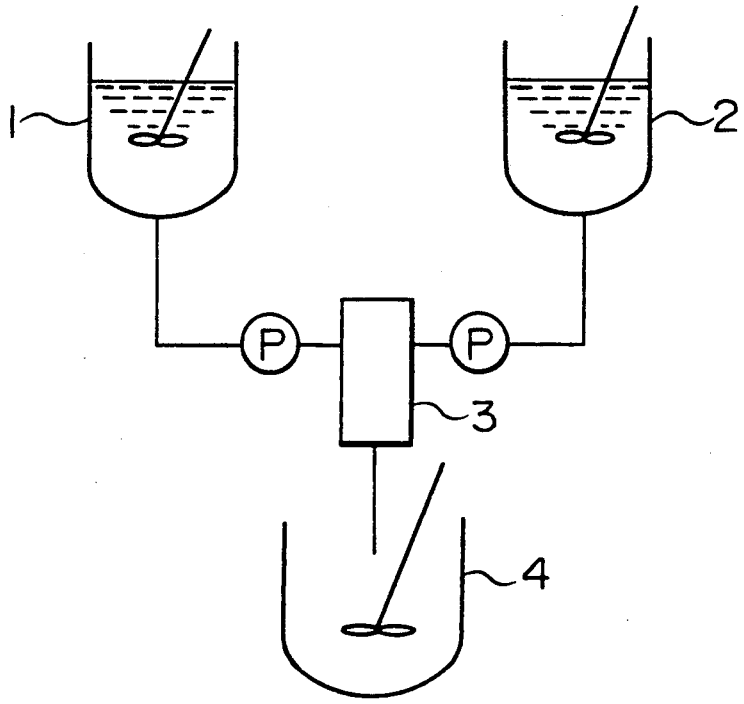
FIG. 1 is a cross-sectional view of an example of the emulsifier/disperser of the invention.

FIG. 1 is a cross-sectional view of an example of the emulsifier/disperser of the invention, in which the respective solutions prepared in a water phase solution preparation tank 1 and an oil phase solution preparation tank 2 are transported by a pump P controlled by a force-feed-system to an in-line mixer 3 for premixing, and then sent to an emulsification tank 4 for emulsification/dispersion.

The above preparation tanks 1 and 2 are ordinary solution-preparation tanks provided with jackets. The premixer 3 may be any one of various in-line mixers, such as a Static Mixer, manufactured by Noritake Co., Ltd., T.K. Homomix Line Flow, manufactured by Tokushu Kikako Co., and Ebara Milder, manufactured by Ebara Mfg. Co., Ltd.

As the emulsification tank 4, any emulsifier/disperser having an ordinary stirrer may be used without restriction.

The flow rate of the oil phase solution divided by that of the water phase solution preferably is not more than 1.2 and not less than 0.1 and more preferably is not more than 1.0 and not less than 0.3.

By doing the predispersion described above the formation of coarse oil globules can be prevented to cause no splattering of oil globules onto the inside wall of the emulsification tank, thus enabling to prevent pinhole trouble at the time of coating a light-sensitive material.

EXAMPLES

The invention is further illustrated in detail by the following examples.

EXAMPLE 1

| | |
|---|---|
| Water phase solution | |
| 10% Sodium dodecylbenzenesulfonate | 1400 ml |
| Photographic gelatin | 3.0 kg |
| Water | 27000 ml |
| Oil phase solution | |
| 1-(2,4,6-trichlorophenyl)-3-[3-(2,4-di-t-aminophenoxyacetamido)benzamido]-5-pyrazolone | 3.0 kg |

-continued

| | |
|---|---|
| Tricresyl phosphate | 3.0 kg |
| Ethyl acetate | 6000 ml |

The apparatus shown in FIG. 1 was used. As a premixer a T.K. Homomix Line Flow was used. The water phase solution and the oil phase solution were supplied at flow rates of 14 liters per minute and 6 liters per minute, respectively, from the respective solution preparation tanks to the premixer.

The mixed liquid was put in a 50-liter emulsification tank, and after that, the liquid was emulsified/dispersed for 50 minutes by a 150 mmϕ dissolver at 4000 rpm.

The average oil globule size and globule size distribution of the obtained emulsion were examined. Next, the emulsion was coated on a polyethylene terephthalate film by a slide hopper-type coater, and then 10 sheets of 1 m×30 cm size coated samples were prepared therefrom. The number of coarse oil globules having not smaller than 10 μm that appeared in the coated area was examined.

EXAMPLE 2

The water phase solution of Example 1 alone was first flow for one minute at a flow rate of 2 liters per minute and then at a flow rate of 12 liters per minute, together with the oil phase solution for 2 minutes at a flow rate of 6 liters per minute for predispersion, and finally the remaining water phase solution was flowed to the emulsification tank. After that, the emulsification/dispersion of the liquid was carried out in the same manner as in Example 1.

COMPARATIVE EXAMPLE 1

The emulsification/dispersion was performed in the same manner as in Example 1 except that, without using the premixer, the oil phase solution was first put in an emulsification tank, and then onto the oil phase solution was added the water phase solution.

The results of the above examples are as follows:

| | Average globule size | Number of coarse oil globules |
|---|---|---|
| Example 1 | 0.21 μm | 2 |
| Example 2 | 0.20 μm | 0 |
| Comparative example 1 | 0.24 μm | 16 |

Figure 2:
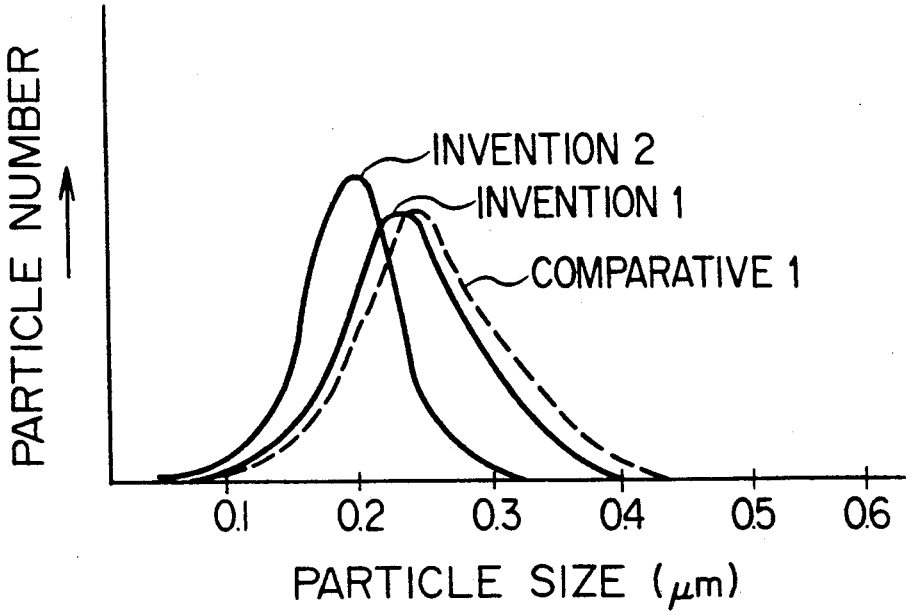
FIG. 2 is a graph showing the numbers of globules in various globular sizes of the emulsions in both Examples and Comparative examples.

The oil globule size distributions of the above examples are shown in FIG. 2.

The average globule size was determined by Coulter model N-4 and the number of coarse oil globules by Coultisizer.

As is apparent from the above results, the examples which use the method and apparatus of the invention show smaller average globule sizes and smaller number of coarse oil globules than those of the comparative example. In addition, the method of Example 2 shows more excellent results than those of Example 1.

Thus, the present invention provides a method and an apparatus useful for preventing the formation of coarse oil globules in the manufacture of emulsions, which results in prevention of the coating trouble attributable to the coarse oil globules.

What is claimed is:

1. A process of making an emulsion for photographic material, comprising;

preparing a water phase solution in a first tank, preparing an oil phase solution in a second tank, premixing the water phase solution and the oil phase solution with an in-line mixer, emulsifying said pre-mixed the water phase solution and the oil phase solution in an emulsification tank, said first tank being air-tightly connected to an inlet of the in-line mixer and the second tank being air-tightly connected to the inlet of the in-line mixer, and an outlet of the in-line mixer being connected to the emulsification tank.

2. The process of claim 1, wherein the water phase solution is delivered by a first force feed system in a first predetermined flow rate.

3. The process of claim 2, wherein the oil phase solution is delivered by a second force-feed-system in a second predetermined flow rate, and wherein the second predetermined flow rate divided by the first predetermined flow rate is not more than 1.20 and not less than 0.10.

4. The process of claim 2, wherein the oil phase solution is delivered by a second force-feed-system in a second predetermined flow rate, and wherein the second predetermined flow rate divided by the first predetermined flow rate is not more than 1.0and not less than 0.3.

5. The process of claim 1, wherein the oil phase solution is delivered by a second force feed system in a second predetermined flow rate.

6. The process of claim 1, wherein the water phase solution starts to be delivered not later than the oil phase solution starts to be delivered.

7. An apparatus for making an emulsion for photographic material comprising:

a first tank to prepare a water phase solution to be delivered by a first force-feed-system at a first predetermined flow rate, a second tank to prepare an oil phase solution to be delivered by a second force-feed-system at a second predetermined flow rate, and wherein the second predetermined flow rate divided by the first predetermined flow rate is not more than 1.20 and not less than 0.10, an in-line mixer to premix the water phase solution and the oil phase solution, an emulsification tank to emulsify said premixed water phase solution and oil phase solution, wherein the first tank is air-tightly connected to an inlet of the in-line mixer and the second tank is air-tightly connected to the inlet of the in-line mixer, and an outlet of the in-line mixer is connected to the emulsification tank to emulsify said premixed solutions.

8. An apparatus for making an emulsion for photographic material comprising:

a first tank to prepare a water phase solution to be delivered by a first force-feed-system at a first predetermined flow rate, a second tank to prepare an oil phase solution to be delivered by a second force-feed-system at a second predetermined flow rate, and wherein the second predetermined flow rate divided by the first predetermined flow rate is not more than 1.0 and not less than 0.3, an in-line mixer to premix the water phase solution and the oil phase solution, an emulsification tank to emulsify said premixed water phase solution and oil phase solution, wherein the first tank is air-tightly connected to an inlet of the in-line mixer and the second tank is air-tightly connected to the inlet of the in-line mixer, and an outlet of the in-line mixer is connected to the emulsification tank to emulsify said premixed solutions.

9. Apparatus for making an emulsion for photographic material comprising:

a first tank to prepare a water phase solution;

a second tank to prepare an oil phase solution;

an in-line mixer to premix the water phase solution and the oil phase solution;

delivery means for regulating delivery of the water phase solution at a first predetermined flow rate and for regulating delivery of the oil phase solution at a second predetermined flow rate, wherein the second predetermined flow rate divided by the first predetermined flow rate is not more than 1.20 and not less than 0.10; and an emulsification tank to emulsify the premixed water phase solution and the oil phase solution, wherein the first tank is air-tightly connected to an inlet of the in-line mixer and the second tank is air-tightly connected to the inlet of the in-line mixer, and an outlet of the in-line mixer is connected to the emulsification tank to emulsify the premixed solutions.

10. The apparatus of claim 9, wherein the delivery means comprises:

a first force-feed-system to regulate delivery of the water phase solution at the first predetermined flow rate; and a second force-feed-system to regulate delivery of the oil phase solution at the second predetermined flow rate.

11. The apparatus of claim 9, wherein the second predetermined flow rate divided by the first predetermined flow rate is not more than 1.0 and not less than 0.3.

* * * * *